US008167168B2

(12) United States Patent
Reynolds

(10) Patent No.: US 8,167,168 B2
(45) Date of Patent: May 1, 2012

(54) DISPENSER WITH AN AUTOMATIC PUMP OUTPUT DETECTION SYSTEM

(75) Inventor: Aaron R. Reynolds, North Canton, OH (US)

(73) Assignee: GOJO Industries, Inc., Akron, OH (US)

( * ) Notice: Subject to any disclaimer, the term of this patent is extended or adjusted under 35 U.S.C. 154(b) by 289 days.

(21) Appl. No.: 12/561,392

(22) Filed: Sep. 17, 2009

(65) Prior Publication Data

US 2011/0062182 A1 Mar. 17, 2011

(51) Int. Cl.
*B67D 5/08* (2006.01)

(52) U.S. Cl. ..... 222/1; 222/63; 222/333

(58) Field of Classification Search ..... 222/1, 23, 222/52, 63, 333, 642, 282
See application file for complete search history.

(56) References Cited

U.S. PATENT DOCUMENTS

| | | | | |
|---|---|---|---|---|
| 4,509,903 | A | 4/1985 | Fram | |
| 4,884,013 | A * | 11/1989 | Jackson et al. | 318/481 |
| 5,295,807 | A | 3/1994 | Wiley et al. | |
| 5,305,915 | A | 4/1994 | Kamysz et al. | |
| 5,605,251 | A | 2/1997 | Retti | |
| 5,730,819 | A | 3/1998 | Retti | |
| 6,012,903 | A | 1/2000 | Boelkins | |
| 6,039,212 | A | 3/2000 | Singh | |
| 6,161,733 | A | 12/2000 | King | |
| 7,111,762 | B2 * | 9/2006 | Saunders et al. | 222/382 |
| 7,267,531 | B2 * | 9/2007 | Anderson et al. | 417/44.11 |
| 2005/0211729 | A1 | 9/2005 | Bassett et al. | |
| 2005/0254979 | A1 | 11/2005 | Fuqua | |
| 2006/0243740 | A1 * | 11/2006 | Reynolds et al. | 222/52 |
| 2006/0263513 | A1 | 11/2006 | Romanin | |
| 2008/0185396 | A1 | 8/2008 | Yang et al. | |
| 2008/0223479 | A1 | 9/2008 | Bassett et al. | |
| 2009/0061368 | A1 | 3/2009 | Caves et al. | |
| 2010/0308076 | A1 * | 12/2010 | Snodgrass | 222/52 |

FOREIGN PATENT DOCUMENTS

| | | | |
|---|---|---|---|
| CA | 923759 | | 4/1973 |
| EP | 1475491 | A2 | 11/2004 |
| WO | 03104754 | A1 | 12/2003 |
| WO | 2004086731 | A2 | 10/2004 |
| WO | 2005112724 | A1 | 12/2005 |

* cited by examiner

*Primary Examiner* — Kevin P Shaver
*Assistant Examiner* — Donnell Long
(74) *Attorney, Agent, or Firm* — Renner, Kenner, Greive, Bobak, Taylor & Weber

(57) ABSTRACT

A dispenser with an automatic pump output detection system provides a pump with an adjustable output. The pump is coupled to a current sensor that generates an operating profile based on the electrical current consumed during each dispensement of material by the pump. A controller that includes one or more previously-stored reference profiles that correspond to discrete pump output amount values that are compared with each generated operating profile, whereby the discrete pump output amounts associated with the matching reference profile is used to compute various usage data associated with the operation of the dispenser.

6 Claims, 2 Drawing Sheets

| | $T_R$ | $C_R$ | Output Amount Value |
|---|---|---|---|
| 500A | 1.5s | 2.5mA | 0.25ml |
| 500B | 1.0s | 3.0mA | 0.50ml |
| 500C | 0.5s | 3.5mA | 0.75ml |

DISPENSER WITH AN AUTOMATIC PUMP OUTPUT DETECTION SYSTEM

TECHNICAL FIELD

The present invention generally relates to dispensers, such as soap dispensers. Particularly, the present invention relates to detection systems that detect changes in the electrical current consumption of a dispensing pump. More particularly, the present invention relates to dispensers that calculate usage data based on pump output that is automatically detected by a pump output detection system.

BACKGROUND OF THE INVENTION

Liquid dispensers are configured with a pump that dispenses a predetermined amount of material, such as soap, during each actuation. However, instances arise in which the amount of material output by the dispenser pump is modified. For example, in the case where moisturizer is substituted for soap, it may be desirable to adjust the output of the pump so that a smaller quantity of moisturizer is dispensed in comparison to the quantity of soap originally dispensed. In addition to the ability to adjust the amount of material that is output by the dispenser, many dispensers are configured to utilize the amount of material that is output by the pump to calculate various information relating to the usage of the dispenser, such as the anticipated time for replacement of the refill container and anticipated replacement interval for the batteries used to operate the dispenser.

In order to identify when the output of the dispenser pump has been changed, a manual switch associated with a dispenser control unit is actuated to indicate that the change has been made. Thus, based on the updated pump output, the controller is able to perform the calculation of the usage data, including the anticipated refill interval for the refill container, as well as the anticipated replacement interval of the batteries used to power the dispenser. Unfortunately in many instances, users of such dispensers forget to actuate the manual switch after a change in pump output, resulting in the incorrect calculation of anticipated refill and battery replacement intervals that are erroneously based on the previous dispensing output of the pump and not the new current output.

Therefore, there is a need for an automatic pump detection system to automatically identify when the output of a dispenser pump has been changed. In addition, there is a need for a pump output detection system for a dispenser that automatically identifies the current amount of material output by the pump. Furthermore, there is a need for an automatic pump output detection system that calculates anticipated refill and battery replacement intervals of the dispenser based on the current output of the pump.

SUMMARY OF THE INVENTION

In light of the foregoing, it is a first aspect of the present invention to provide a dispenser for dispensing material from a refill container comprising a memory unit that provides at least one reference profile associated with a pump output amount value; a pump adapted to be fluidly coupled to the refill container so as to dispense material therefrom; a current sensor coupled to said pump to generate an operating profile associated with the electrical current consumed by the operation of said pump; a controller coupled to said memory unit, said pump, and said current sensor, said controller configured to compute at least one usage value; and an actuator coupled to said controller to actuate said pump when engaged, such that said operating profile is compared with said at least one reference profile, wherein said pump output amount value associated with said reference profile that matches said operating profile is used by said controller to compute said at least one usage value.

It is another aspect of the present invention to provide a method of operating a dispenser comprising the steps of providing a dispenser having a pump to dispense material therefrom, said dispenser including at least one reference profile associated with a pump output amount value; adjusting the output of said pump; operating said pump; generating an operating profile based on the operation of said pump; and identifying said pump output amount value that is associated with the reference profile that matches said operating profile.

Yet another aspect of the present invention is to provide a dispenser for dispensing material from a refill container comprising a pump adapted to be fluidly coupled to the refill container, so as to dispense material therefrom; a controller coupled to said pump; an actuator coupled to said controller to actuate said pump when engaged; and a current sensor coupled to said controller to generate an operating profile associated with the electrical current consumed by the operation of said pump when said actuator is engaged, wherein said operating profile is processed by said controller to identify a pump output amount value of said pump, which is used by said controller to compute said at least one usage value.

BRIEF DESCRIPTION OF THE DRAWINGS

These and other features and advantages of the present invention will become better understood with regard to the following description, appended claims, and accompanying drawings where:

BEST MODE FOR CARRYING OUT THE INVENTION

Figure 1:
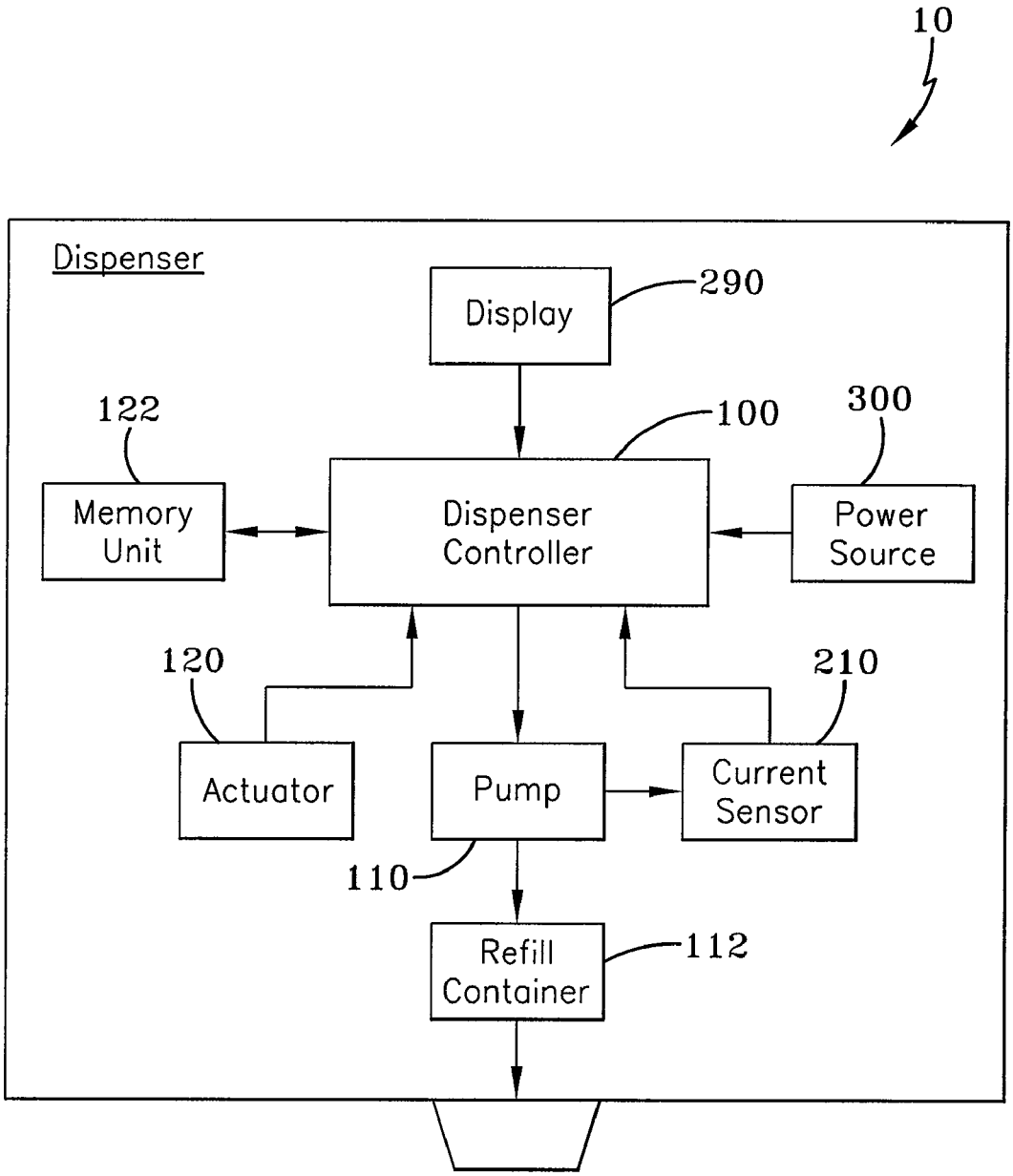
FIG. 1 is a block-diagram of a dispenser that provides an automatic pump output detection system in accordance with the concepts of the present invention.

A dispenser with an automatic pump output detection system is generally referred to by the numeral 10, as shown in FIG. 1 of the drawings. The dispenser 10 includes a controller 100 that actuates an adjustable pump 110 that is configured to dispense different amounts of material, such as soap, that is provided by a refill container 112 upon the engagement of an actuator 120. The controller 100 monitors the electrical current drawn by the pump 110 each time the actuator 120 is engaged and correspondingly generates an operating profile that identifies various parameters associated with the consumption of electrical current over time. Each generated operating profile is compared to reference profiles that have been previously stored at a memory unit 122 and which are associated with discrete output amount values that the pump 110 is capable of dispensing. As such, if a change in the output quantity or amount of the pump 110 is made, a corresponding operating profile is generated and compared to the stored reference profiles in order to ascertain the particular quantity of material, or shot size, that the pump 110 is dispensing or otherwise outputting. As such, the system 10 automatically detects the particular output of the pump 110, allowing the controller 100 to accurately compute various anticipated service intervals, such as anticipated replacement of refill container 112 for example.

Specifically, the controller 100 provided by the system 10 comprises the necessary hardware and/or software to carry out the functions to be discussed. Coupled to the controller 100 is the pump 110 that is in fluid communication with the refill container 112, which is configured to carry any desired liquid material, including, but not limited to, soap, moisturizer, and disinfectant. To control operation of the pump 110, the actuator 120 is coupled to the controller 100, such that when the actuator 120 is engaged by a user, the controller 100 activates the pump 110 in a manner to dispense an amount of material from the refill container 112. In one aspect, the actuator 120 may comprise a button, as well as a proximity sensor, biometric sensor, or any other sensor suitable for initiating the operation of the pump 110 upon the detection of the presence of a user's hand or portion thereof.

It should be appreciated that the components of the dispenser 10, including the pump 110 itself, may be readily modified and/or replaced to enable the amount of material output by the pump 110 to be increased or decreased.

The dispenser 10 also includes the memory unit 122 that is coupled to the controller 100 and may comprise any suitable volatile or non-volatile memory. In order to monitor the electrical current drawn by the pump 110 during the operation of the dispenser 10, a current sensor 210 is coupled between the controller 100 and the pump 110. The current sensor 210 is configured to monitor electrical current that is consumed by the pump 110 when it is activated upon the engagement of the actuator 120. It should be appreciated that the memory unit 122 may be configured as a portable memory unit.

A display 290 is also coupled to the controller 100 to display various data associated with the operation of the dispenser 10. In one aspect, the display 290 may comprise an LCD (liquid crystal display) display, an LED (light emitting diode) display, or a display of any other suitable type. Continuing, the controller 100 is configured to generate various usage data, including service interval values that identify the remaining operating life or operating capacity of the contents of the refill container 112 and/or the remaining operating life or operating capacity of the battery 300 based on the past usage of the dispenser 10. In addition, the controller 100 may be configured to generate service interval values and other related values, such as those disclosed in U.S. patent application Ser. No. 12/425,444, entitled "Method and Device for Indicating Future Need for Product Replacement of Random-Use Dispensing," which is jointly owned with the present application and incorporated herein by reference. Also coupled to the controller 100 is a display 290, such as an LCD (liquid crystal display) display or other suitable display, that allows individuals charged with maintaining the dispenser 10 to view the calculated usage value or service interval.

The components of the dispenser 10 are powered by a power source 300 that is coupled to the controller 100. The power source 300 may comprise any suitable source of power, including, but not limited to, battery power and A.C. (alternating current) mains power that is supplied by an electrical outlet. In the case where the power source 300 comprises a battery, it should be appreciated that the controller 100 may be configured to identify its remaining operating capacity for presentation by the display 290.

As such, the current sensor 210 is configured to monitor the electrical current that is consumed by the pump 110 during the period of time it is in operation after the engagement of the actuator 120. That is, the current sensor 210 monitors the electrical current consumed by the pump 110 as it is dispensing an amount of material from the refill container 112. Specifically, the current sensor 210 generates an operating profile 400, which is graphically shown in FIG. 2, that represents the electrical current (I) consumed by the pump 110 with respect to the time over which the pump 110 is in operation. Thus, once the operating profile 400 is generated, it is processed by the controller 100, whereby the priming time ($T_1$) associated with the initial operation of the pump 110 is identified, along with the identification of the peak magnitude ($C_1$) of the electrical current that is consumed by the pump 110. It should be appreciated that the priming time ($T_1$) is established as the time between an initial start time (X), which is defined as the point when the pump 110 is started, and an end time (Y), which is the point at which the electrical current (I) first begins to increase following an initial current drop.

Figures 2, 3:
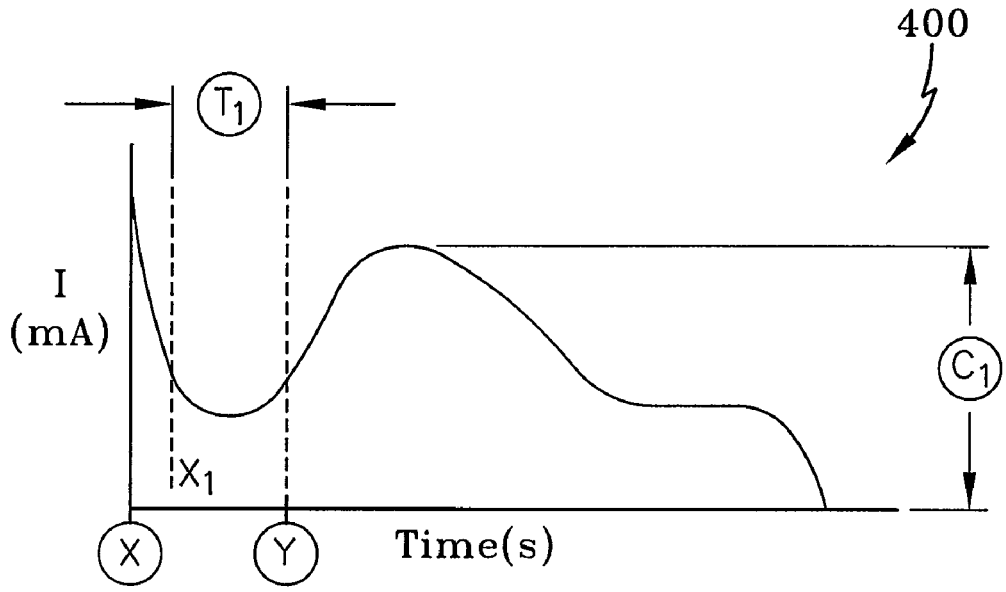
FIG. 2 is a graph showing an operating profile that includes priming time ($T_1$) and peak current magnitude ($C_1$) values that are generated during the operation of a pump in accordance with the concepts of the present invention.
FIG. 3 is a table showing reference profiles that include priming time ($T_R$) and peak current magnitude ($C_R$) values that are associated with specific output amount values in accordance with the concepts of the present invention.

In another aspect, it should be appreciated that the initial start time (X) may be defined as the time at which an initial current drop, identified as ($X_1$) in FIG. 3, is experienced after the pump 110 has been started.

Thus, each time the pump 110 is activated, the operating profile 400 defined by the priming time ($T_1$) and the peak magnitude ($C_1$) of the electrical current consumed by each actuation of the pump 110 is processed by the controller 100 and compared with one or more reference profiles 500A-C, as shown in FIG. 3, that have been previously stored at the memory unit 122. Specifically, the reference profiles 500A-C identify priming times ($T_R$) and peak current magnitudes ($C_R$) that are associated with discrete pump output amount values, such as 0.25 ml, 0.5 ml, and 0.75 ml, although any pump output amount that can be delivered by the pump 110 may be identified by the reference profile 500. For example, as shown in FIG. 3, the reference profile 500A associates a pump output amount of 0.25 ml with a priming time ($T_R$) of 1.5 seconds and a peak current magnitude ($C_R$) of 2.5 mA; reference profile 500B associates a pump output amount of 0.5 ml with a priming time ($T_R$) of 1 second and a peak current magnitude ($C_R$) of 3 mA; and reference profile 500C associates a pump output amount of 0.75 ml with a priming time ($T_R$) of 0.5 seconds and a peak current magnitude ($C_R$) of 3.5 mA.

As a result, each time the actuator 120 is engaged, the priming time ($T_1$) and peak current magnitude ($C_1$) values associated with each operating profile 400 generated by the current sensor 210 are compared with the priming time ($T_R$) and peak current magnitude ($C_R$) values that are associated with the reference profiles 500A-C that are stored at the memory unit 122. Thus, the output amount value associated with the priming time ($T_R$) and the peak current magnitude ($C_R$) values of a specific reference profile 500A-C that matches the priming time ($T_1$) and peak current magnitude ($C_1$) values of the generated operating profile 400 is utilized by the controller 100 in the calculation of the usage data, such as various service intervals. As such, based on this comparison, the controller 100 is able to determine the output amount that the pump 110 is currently delivering. Thus, if the user has modified the output amount that is delivered by the pump 110, the controller 100 is able to automatically determine what the new output amount is from the comparison of the operating profile 400 with the stored reference profiles 500.

For example, during operation of the dispenser 10, the priming time ($T_R$) and peak current magnitude ($C_R$) values of the reference profiles 500A-C may be associated with pump output amounts of 0.25 ml, 0.50 ml, and 0.75 ml. Additionally, during the operation of the dispenser 10, the controller 100 and current sensor 210 monitor the operating profiles 400 generated from the operation of the pump 110. In the event that the current sensor 210 detects an operating profile 400 having a priming time ($T_1$) of 1.5 seconds and a peak current magnitude ($C_1$) of 2.5 mA, which matches the corresponding priming time ($T_R$) and peak current magnitude ($C_R$) of the reference profile 500, a pump output amount value of 0.25 ml, is utilized by the controller 100 in the calculation of usage data. Moreover, the usage data may also include the calculation of a refill container 112 service interval and a battery service interval value that may be presented via the display 290.

It should also be appreciated that in addition to the priming time ($T_R$) and peak current magnitude values ($C_R$), the reference profile 500 and the operating profile 400 may be defined by any other suitable electrical parameter associated with the operation of the pump 110.

Thus, by ensuring that the controller 100 is utilizing the pump output amount value that identifies that current output of the pump 110, calculations performed by the controller 100 to compute various operational data for the user are ensured to be accurate.

In one aspect, the operating profile 400 and the reference profiles 500 may be defined by one of either the peak current magnitude (C) or the priming time (T). Or alternatively, in other embodiments, the operating and reference profiles 400, 500 may be defined by both the current magnitude (C) and the pump priming time (T).

Thus, when calculating the remaining service interval of the refill container 112 and/or batteries 300, it is critical that the correct output amount value associated with the pump 110 be used, otherwise a misleading service interval will be calculated. However, because the dispenser 10 automatically identifies the current output quantity of the pump 110, the usage data computed by the controller 100 is accurate, preventing the calculation of inaccurate service interval values, thereby allowing the efficient replacement of the refill container 112 and/or batteries 300 when needed.

In another embodiment of the dispenser 10, the dispenser controller 100 may be programmed with an algorithm or other suitable operating sequence that is enabled to ascertain the specific dispensing volumes or the amount of material output by the pump 110 directly from the operating profile that is generated by the current sensor 210 during the engagement of the actuator 120. Such an embodiment provides the benefit of allowing the dispenser 10 to not be constrained to specific discrete pump 110 output amounts, as discussed with regard to previous embodiments of the dispenser 10.

It will, therefore, be appreciated that one advantage of one or more embodiments of the present invention is that a dispenser with an automatic pump output detection system allows a controller to compute various operational information based on the current quantity of material output by the pump. Another advantage of the present invention is that the automatic pump output detection system provides a pump with an adjustable output. Still another advantage of the present invention is that the automatic pump output detection system automatically identifies a change in the amount of material output by the pump. Although the present invention has been described in considerable detail with reference to certain embodiments, other embodiments are possible. Therefore, the spirit and scope of the appended claims should not be limited to the description of the embodiments contained herein.

What is claimed is:

1. A dispenser for dispensing material from a refill container comprising:

a memory unit that stores at least one reference profile associated with a pump output amount value, said at least one reference profile defined as a priming time value and a peak current magnitude value;

a pump adapted to be fluidly coupled to the refill container so as to dispense material therefrom, wherein said pump is configured such that the amount of material dispensed therefrom is adjustable;

a current sensor coupled to said pump to generate an operating profile defined as a priming time value and a peak current magnitude value of the electrical current waveform consumed by the operation of said pump;

a controller coupled to said memory unit, said pump, and said current sensor, said controller configured to compute at least one usage value; and an actuator coupled to said controller to actuate said pump when engaged, such that said priming time value and said peak current magnitude value of said operating profile is compared with said priming time value and said peak current magnitude value of said at least one reference profile, wherein said pump output amount value associated with said reference profile that matches said operating profile is used by said controller to compute said at least one usage value.

2. The dispenser of claim 1, wherein said memory unit is configured to be portable.

3. The dispenser of claim 1, further comprising a display coupled to said controller to display said usage value.

4. A method of operating a dispenser comprising the steps of:

providing a dispenser having a pump to dispense material therefrom, said dispenser having a memory unit to store at least one reference profile associated with a pump output amount value, said reference profile defined as a priming time value and a peak current magnitude value;

adjusting the output at said pump;

operating said pump;

generating an operating profile based on the operation of said pump, said operating profile defined as a priming time value and a peak current magnitude value of the electrical current waveform consumed by the pump during said operating step;

comparing said operating profile to said at least one reference profile; and identifying said pump output amount value that is associated with the reference profile that matches said operating profile.

5. The method of claim 4, further comprising calculating usage data based on said pump output amount value identified at said identifying step.

6. The method of claim 5, further comprising displaying said usage data on a display provided by said dispenser.

* * * * *